US006774347B2

(12) United States Patent
Shon et al.

(10) Patent No.: US 6,774,347 B2
(45) Date of Patent: Aug. 10, 2004

(54) MICROWAVE OVEN WITH HUMIDITY SENSOR

(75) Inventors: Jong-Chull Shon, Suwon (KR); Keun-Seuk Oh, Suwon (KR); So-Hyun Lee, Suwon (KR); Won-Woo Lee, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 39 days.

(21) Appl. No.: 10/005,222

(22) Filed: Dec. 7, 2001

(65) Prior Publication Data

US 2003/0106892 A1 Jun. 12, 2003

(51) Int. Cl.[7] ..... H05B 6/68
(52) U.S. Cl. ..... 219/707; 219/757
(58) Field of Search ..... 219/707, 705, 219/703, 716, 704, 715, 718, 719, 757; 99/325; 73/1.07, 1.02

(56) References Cited

U.S. PATENT DOCUMENTS 4,582,971 A * 4/1986 Ueda ..... 219/685
5,235,148 A * 8/1993 Yamaguchi et al. ..... 219/707
5,744,785 A * 4/1998 Lee ..... 219/707
5,786,577 A * 7/1998 Han et al. ..... 219/682
5,847,261 A * 12/1998 Lee ..... 73/1.07

FOREIGN PATENT DOCUMENTS

JP 06-109262 4/1994

* cited by examiner

*Primary Examiner*—Quang T. Van
(74) *Attorney, Agent, or Firm*—Staas & Halsey LLP

(57) ABSTRACT

A microwave oven includes a humidity sensor, a main-outlet and a sub-outlet formed at opposite sidewalls of a cooking cavity such that the cooking cavity communicates with the atmosphere through the main-outlet and the sub-outlet. The sub-outlet is installed in a machine room adjacent an air inlet side of a cooling fan. The humidity sensor is installed in the machine room at a position adjacent to the sub-outlet and senses the humidity of air inside the cooking cavity by sensing the humidity of a part of the air discharged from the cooking cavity through the sub-outlet. The surface of the humidity sensor is less likely to be easily contaminated by the air exhausted from the cooking cavity, moisture deposited on the surface of the humidity sensor 60 is quickly evaporated so that the humidity sensor performs its desired operation even when the microwave oven sequentially performs several cooking processes.

27 Claims, 7 Drawing Sheets

MICROWAVE OVEN WITH HUMIDITY SENSOR

BACKGROUND OF THE INVENTION

1. Field of the Invention

The present invention relates, in general, to microwave ovens and, more particularly, to a microwave oven provided with a humidity sensor to sense humidity in the cooking cavity of the oven by sensing humidity of air exhausted from the cooking cavity.

2. Description of the Prior Art

A microwave oven is an electrically operated oven that uses a magnetron to generate high-frequency electromagnetic waves, which are waves having a fundamental frequency of 2450 MHz. The electromagnetic waves are radiated into a cooking cavity to repeatedly change the molecular arrangement of moisture laden in food, thus generating intermolecular frictional heat within the food which ultimately cooks the food.

In recent years, in order to meet a variety of requirements of consumers, a microwave oven with a humidity sensor has been proposed and used. In an operation of such a microwave oven, the humidity sensor determines the humidity of air inside the cooking cavity, and automatically controls the cooking process based upon this determination.

As shown in FIG. 1, a conventional microwave oven with a humidity sensor 6 comprises a body 1, the interior of which is partitioned into a cooking cavity 2 and a machine room 3. A door 4 is hinged to the body 1 so as to close the cooking cavity 2. The microwave oven also has a control panel 5, which is installed at a front wall of the body 1 and is provided with a variety of control buttons. The humidity sensor 6 is installed in the body 1 to sense the operational conditions of the food in the cooking cavity 2.

The cooking cavity 2 is opened at its front, and has a turntable-type cooking tray 2*a* rotatably mounted on the bottom of the cavity 2. An air inlet 7*a* is formed at a front portion of a sidewall 7 of the cooking cavity 2 so as to allow the cooking cavity 2 to communicate with the machine room 3. Air flows from the machine room 3 into the cooking cavity 2 through the air inlet 7*a*. An air outlet 8*a* is formed at a rear portion of an opposite sidewall 8 of the cooking cavity 2 so as to discharge air exhausted from the cooking cavity 2 to the atmosphere exterior to the body 1.

A magnetron 3*a*, a cooling fan 3*b*, an air guide duct 3*c* and other similar elements (not shown) are installed within the machine room 3. The magnetron 3*a* generates the high-frequency electromagnetic waves, while the cooling fan 3*b* sucks atmospheric air into the machine room 3 so as to cool the elements installed within the machine room 3. The air guide duct 3*c* guides the air inside the machine room 3 to the air inlet 7*a*. The cooling fan 3*b* is installed at a position between the magnetron 3*a* and a rear wall of the machine room 3. In order to allow atmospheric air to flow into the machine room 3 from exterior to the body 1, a predetermined area of the rear wall of the machine room 3 is perforated to form a plurality of air suction holes 3*d*.

The humidity sensor 6 is installed on the sidewall 8 of the cooking cavity 2 at a position adjacent to the air outlet 8*a*. Thus, the humidity sensor 6 is placed in an air discharging passage leading from the cooking cavity 2 to the atmosphere exterior to the body 1. The humidity sensor 6 thus senses the humidity of the exhaust air discharged from the cooking cavity 2 through the air outlet 8*a*. This humidity sensor 6 is connected to a circuit board (not shown) installed in the control panel 5, and outputs a signal to the circuit board. When turning on the microwave oven containing food on the cooking tray 2*a* by manipulating the control panel 5, the high-frequency electromagnetic waves are radiated from the magnetron 3*a* into the cooking cavity 2 and the food is cooked.

During such an operation of the microwave oven the cooling fan 3*b* is rotated to form a suction force. The suction force sucks the atmospheric air into the machine room 3 through the air suction holes 3*d* and cools the elements installed in the room 3. The air is, thereafter, guided to the air inlet 7*a* by the air guide duct 3*c* and introduced into the cooking cavity 2 through the air inlet 7*a*. The air inside the cooking cavity 2 is exhausted along with the vapor generated from the food to the atmosphere through the air outlet 8*a* as shown by the arrows of FIG. 1. Therefore, it is possible to remove odor and vapor generated from food during the operation of the microwave oven.

When the exhaust air flows from the cooking cavity 2 to the atmosphere, it comes into contact with the humidity sensor 6. The humidity sensor 6 senses the humidity of the exhaust air, and outputs a signal to the circuit board of the control panel 5. The circuit board of the control panel 5 controls the operation of the magnetron 3*a*, the cooking tray 2*a* and the cooling fan 3*b* in response to the signal from the humidity sensor 6 to automatically cook the food on the tray 2*a*.

However, the above conventional microwave oven is problematic since the humidity sensor 6 is installed at a position close to the air outlet 8*a* through which air is discharged from the cooking cavity 2 to the atmosphere exterior to the body 1. When the microwave oven sequentially performs several cooking processes, the air inside the cooking cavity 2 is excessively heated and discharged to the atmosphere through the air outlet 8*a*, which overheats the humidity sensor 6 and reduces the sensing performance of the sensor 6. In addition, moisture and contaminants, such as oil and smoke, generated from food during the cooking processes are deposited onto the surface of the humidity sensor 6 when they flow from the cooking cavity 2 to the atmosphere along with the exhaust air through the air outlet 8*a*. The moisture and contaminants deposited on the surface of the humidity sensor 6 are not easily removed from the humidity sensor 6, which further reduces the sensing performance of the humidity sensor 6.

SUMMARY OF THE INVENTION

In order to accomplish the above and other problems, an object of the present invention is to provide a microwave oven having a humidity sensor and an improved air outlet structure and humidity sensor mounting structure so as to prevent the humidity sensor from being overheated and/or contaminated by air exhausted from the cooking cavity.

An additional object of the present invention is to provide a microwave oven having a humidity sensor and an improved air outlet structure and humidity sensor mounting structure so as to prevent the humidity sensor from being overheated or contaminated by air exhausted from the cooking cavity, and to allow the humidity sensor to precisely sense the humidity of air inside the cooking cavity during a cooking process.

Additional objects and advantages of the invention will be set forth in part in the description which follows and, in part, will be obvious from the description, or may be learned by practice of the invention.

In order to accomplish the above and other objects of the invention, a microwave oven includes a body including a cooking cavity and a machine room, a cooling fan installed in the machine room to suck atmospheric air through an air inlet into the cooking cavity while cooling a variety of elements installed in the machine room, an air outlet unit to discharge air from the cooking cavity, and a humidity sensor to sense operational conditions of the cooking cavity, wherein the air outlet unit includes a main-outlet formed at a sidewall of the cooking cavity to allow the cooking cavity to communicate with the atmospheric air exterior to the body, and a sub-outlet formed at an opposite sidewall of the cooking cavity to allow the cooking cavity to communicate with an air inlet side of the cooling fan, and the humidity sensor senses the humidity of air discharged from the cooking cavity through the sub-outlet.

According to an aspect of the invention, the machine room further includes an air guide to guide the air from the sub-outlet to the air inlet side of the cooling fan, and the humidity sensor is arranged on a rear surface of the air guide so as to be positioned adjacent to the sub-outlet.

According to another aspect of the invention, the machine room further includes an air suction hole at a rear wall to suck the atmospheric air into the machine room, and the humidity sensor is arranged adjacent to the air suction hole such that the moisture deposited on the humidity sensor is removed from the sensor by the atmospheric air sucked into the machine room through the air suction hole.

According to another embodiment of the present invention, a microwave oven includes a body including a cooking cavity and a machine room, a cooling fan installed in the machine room to suck atmospheric air into the cooking cavity through an air inlet while cooling a variety of elements installed in the machine room, an air outlet unit to discharge air from the cooking cavity, and a humidity sensor to sense operational conditions of food in the cooking cavity, wherein the air outlet unit includes a main-outlet formed at a sidewall of the cooking cavity to allow the cooking cavity to communicate with the atmospheric air exterior to the body, and a sub-outlet formed at an opposite sidewall of the cooking cavity to allow the cooking cavity to communicate with the air inlet side of the cooling fan, a ratio of the area of the sub-outlet to the total area of the main-outlet and the sub-outlet is roughly between 10 and 25%, and the humidity sensor senses the humidity of the air discharged from the cooking cavity through the sub-outlet.

According to another aspect of the invention, a ratio of the area of the main-outlet to the total area is roughly between 70 and 70%, and the ratio of the area of the sub-outlet to the total area is roughly between 20 and 25%.

According to a further embodiment of the present invention, a microwave oven includes a body including a cooking cavity and a machine room, a cooling fan installed in the machine room to suck atmospheric air exterior to the body into the cooking cavity and through an air inlet while cooling a variety of elements installed in the machine room, an air outlet unit to discharge air from the cooking cavity, and a humidity sensor to sense operational conditions of the cooking cavity, wherein the air outlet unit includes a main-outlet formed at a sidewall of the cooking cavity to allow the cooking cavity to communicate with the atmospheric air exterior to the body, and a sub-outlet formed at another sidewall of the cooking cavity to allow the cooking cavity to communicate with the air inlet side of the cooling fan, a sub-outlet piercing ratio of a total area of openings in the sub-outlet to a total area of the sub-outlet is 2% or more greater than an inlet piercing ratio of a total area of openings in the air inlet to a total area of the air inlet, and the humidity sensor senses the humidity of the air discharged from the cooking cavity through the sub-outlet.

According to a further aspect of the invention, the sub-outlet piercing ratio is 5% or more greater than the air inlet piercing ratio.

BRIEF DESCRIPTION OF THE DRAWINGS

The above and other objects, features and other advantages of the present invention will be more clearly understood and more readily appreciated from the following detailed description of the embodiments of the invention taken in conjunction with the accompanying drawings, in which.

DETAILED DESCRIPTION OF THE PREFERRED EMBODIMENTS

Figure 1:
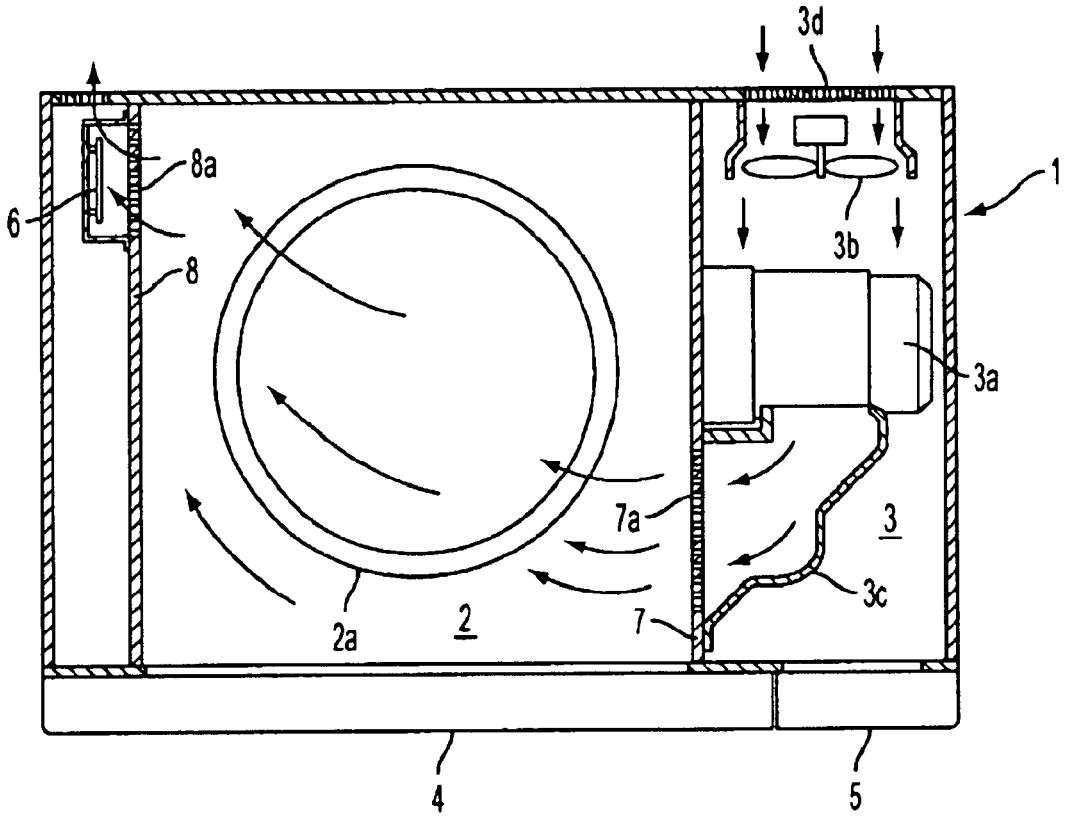
FIG. 1 PRIOR ART
FIG. 1 is a sectional view of a conventional microwave oven with a humidity sensor.

Reference will now be made in detail to the present preferred embodiments of the present invention, examples of which are illustrated in the accompanying drawings, in which the same reference numerals are used throughout the different drawings to designate the same or similar components. The embodiments are described below in order to explain the present invention by referring to the figures.

Figure 2:
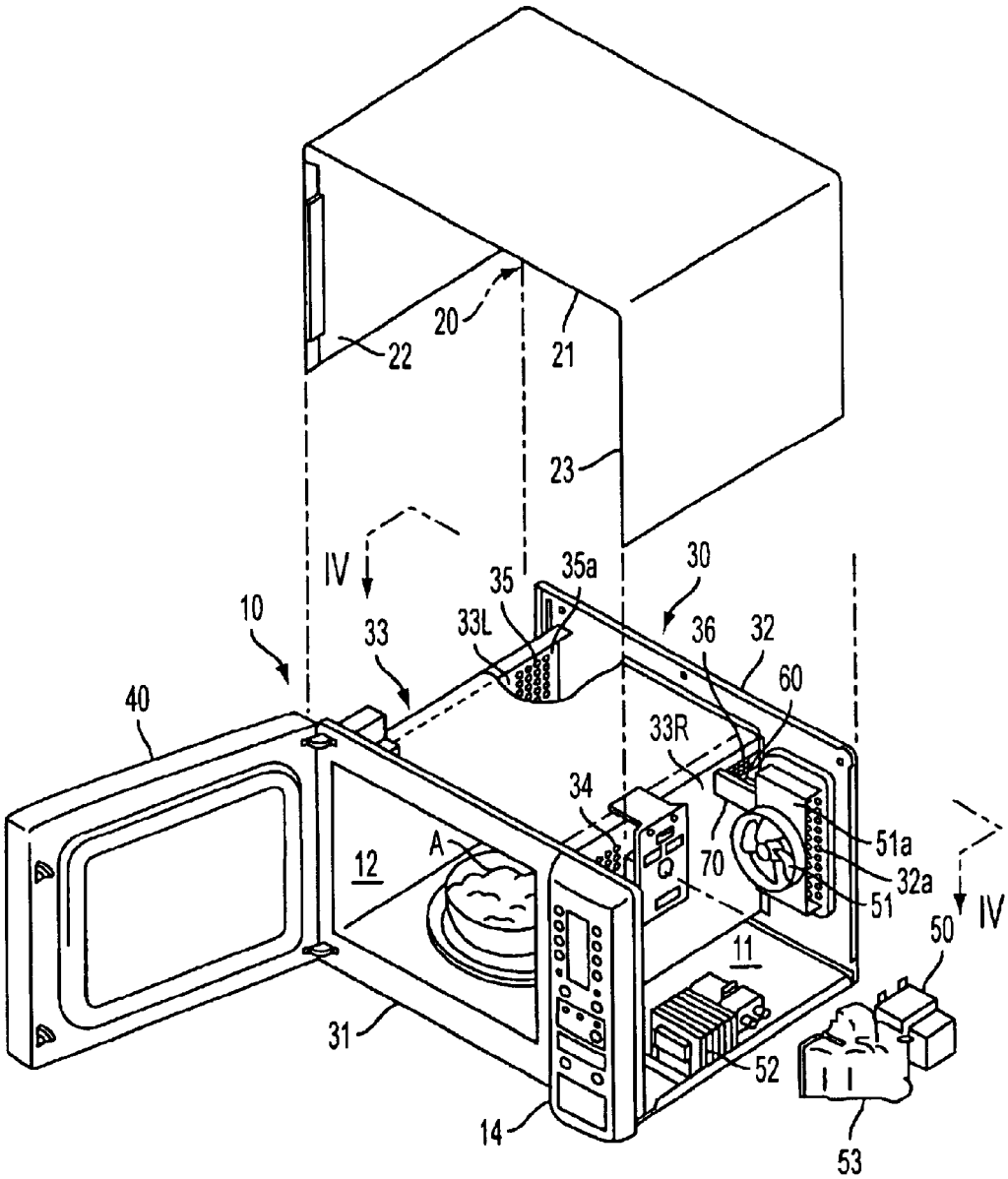
FIG. 2 is an exploded perspective view of a microwave oven with a humidity sensor in accordance with an embodiment of the present invention.
Figure 3:
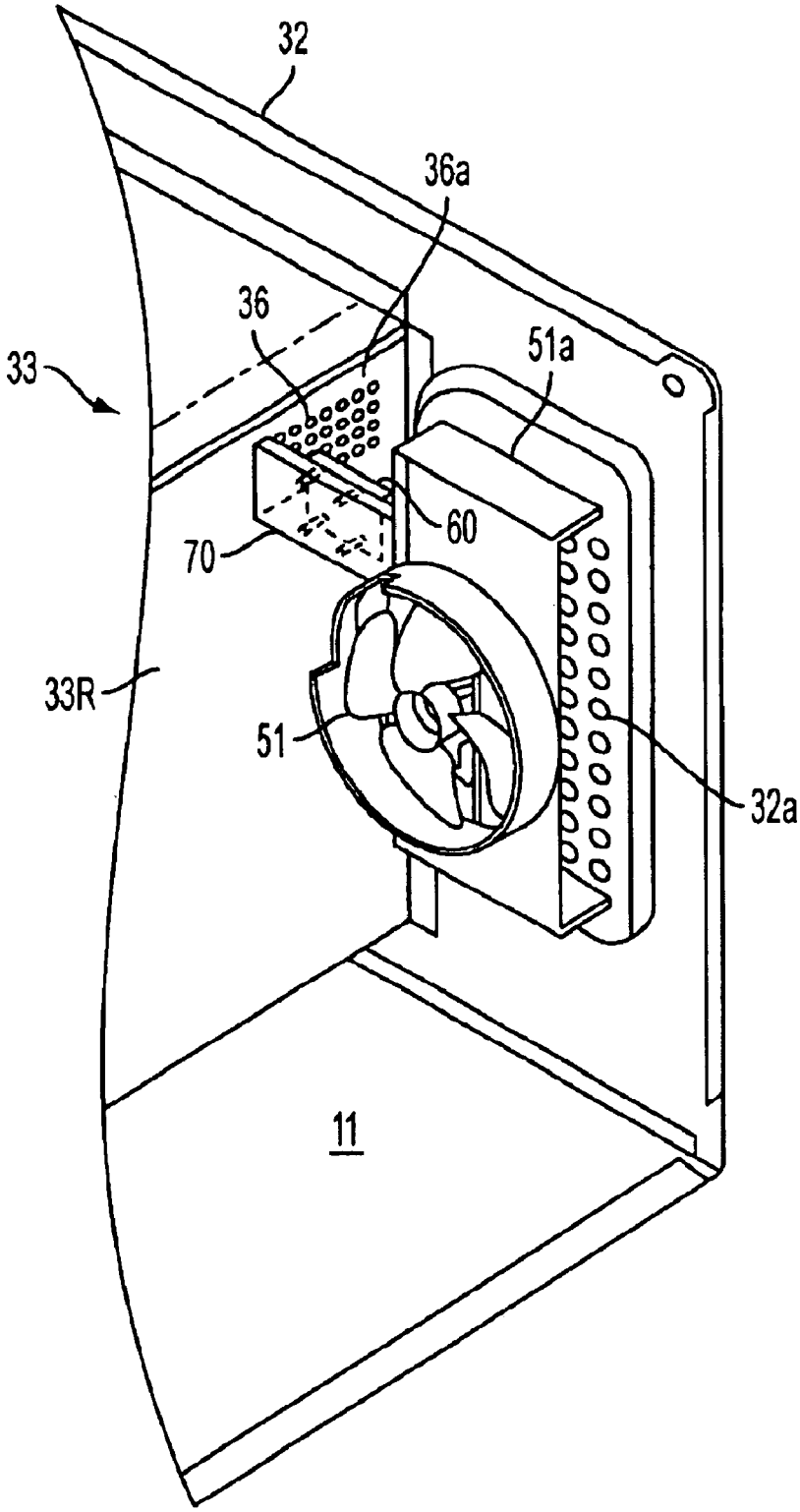
FIG. 3 is a perspective view showing a humidity sensor mounting structure provided in the microwave oven according to an embodiment of the present invention.
Figure 4:
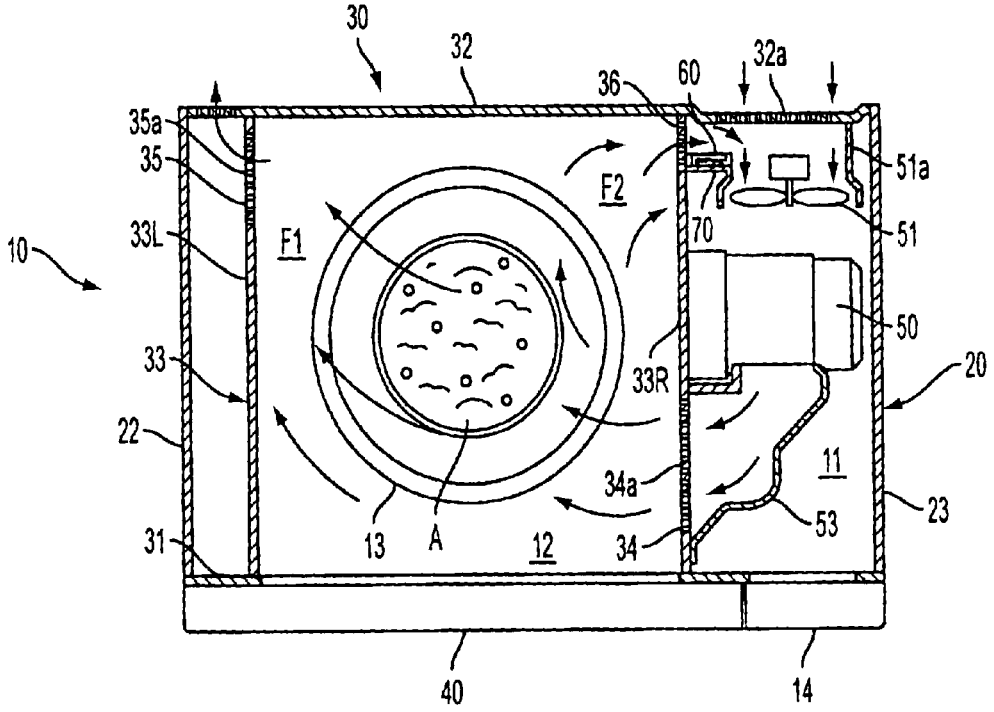
FIG. 4 is a sectional view taken along the line IV—IV of FIG. 2, showing an air outlet structure to discharge air from the cooking cavity of the microwave oven according to an embodiment of the present invention.

FIGS. 2 and 3 show the interior of a microwave oven in accordance with an embodiment of the invention. FIG. 4 shows an air circulation structure of the microwave oven. As shown in FIG. 2, the microwave oven comprises a body 10, the interior of which is partitioned into a machine room 11 and a cooking cavity 12. A turntable-type cooking tray 13 is rotatably mounted on a bottom of the cavity 12. A door 40 is hinged to the front edge of the body 10 so as to close the cooking cavity 12. The microwave oven also has a control panel 14, which is installed at a front wall of the machine room 11 and has a circuit board (not shown) controlling the operation of the microwave oven. A humidity sensor 60 is installed in the body 10 to sense the operational conditions of the cooking cavity 12 by sensing the humidity of air inside the cooking cavity 12. Specifically, the air inside the cooking cavity 12 is humidified by vapor generated from food A during a cooking process. The humidity sensor 60 is connected to the circuit board of the control panel 14, and outputs a signal to the circuit board indicating the amount of the vapor.

The body 10 includes an inner casing 30 and an outer casing 20. The inner casing 30 defines the cooking cavity 12 therein, while the outer casing 20 is detachably assembled with the inner casing 30 and defines the machine room 11 separated from the cooking cavity 12. The outer casing 20 has an inverted U-shaped cross-section, with two sidewalls 22 and 23 covering outer side portions of the inner casing 30 and one top wall 21 covering a top portion of the inner casing 30. The front and rear edges of the outer casing 20 engage with the front and rear plates 31 and 32 of the inner casing 30 as will be described in detail later herein, thus forming an appearance of the microwave oven.

The inner casing 30 comprises a box-shaped housing 33 in addition to the front and rear plates 31 and 32. The housing 33 defines a cooking cavity 12 therein. The front plate 31 is mounted to the front end of the housing 33 and defines the front opening of the cooking cavity 12. The rear plate 32 is mounted to the rear end of the housing 33 so as to close a rear end of the cooking cavity 12. The front and rear plates 31 and 32 have extensions that provide the front and rear walls of the machine room 11. The control panel 14 is installed on the extension of the front plate 31, while air suction holes 32*a* are formed at the extension of the rear plate 32 to allow the atmospheric air to flow into the machine room 11.

A magnetron 50, a high-tension transformer 52, a cooling fan 51, an air guide duct 53, and other similar devices (not shown) are installed within the machine room 11. The magnetron 50 generates the high-frequency electromagnetic waves that are radiated into the cooking cavity 12. The high-tension transformer 52 applies a high voltage to the magnetron 50 to generate the electromagnetic waves. The cooling fan 51 sucks the atmospheric air into the machine room 11 to cool the elements installed within the machine room 11. The air guide duct 53 guides the air from the machine room 11 into the cooking cavity 12. A fan bracket 51*a* is installed inside the rear section of the machine room 11 at a position close to the air suction holes 32*a* of the rear plate 32. The cooling fan 51 is rotatably mounted to the fan bracket 51*a*. The air guide duct 53 surrounds an air inlet 34 formed at the sidewall 33R of the housing 33 of the inner casing 30. When the cooling fan 51 is rotated, the atmospheric air is sucked into the machine room 11 through the air suction holes 32*a*, thus cooling the elements inside the machine room 11. Thereafter, the air flows from the machine room 11 into the cooking cavity 12 through the air inlet 34 under the guide of the air guide duct 53.

The sidewall of the cooking cavity 12 is provided with an air outlet unit to discharge air from the cavity 12 along with vapor generated from the food A. The air outlet unit includes air outlets 35 and 36 formed at corresponding sidewalls of the cooking cavity 12. The humidity sensor 60 is arranged such that it comes into contact with air exhausted from the cooking cavity 12 through the air outlet 36. The construction of the air outlet unit and the mounting structure for the humidity sensor 60 will be described in detail herein below.

A main-outlet 35 is formed at a rear portion of a sidewall 33L of the housing 33 of the inner casing 30 defining the cooking cavity 12. The main-outlet 35 allows the cooking cavity 12 to communicate with the atmosphere so as to exhaust air from the cooking chamber 12 into the atmosphere. The air inlet 34 includes air inlet holes formed at the front portion of opposite sidewall 33R of the housing 33. This air inlet 34 allows the cooking cavity 12 to communicate with the machine room 11. The air inlet 34 and the main-outlet 35 are formed at the two sidewalls of the housing 33 while being diagonally opposite to each other. As such, air effectively circulates within the cooking cavity 12 prior to being discharged from the cavity 12 to the atmosphere. It is understood that the air inlet 34, and the main outlet 35 may be formed on adjacent sidewalls or on top and bottom surfaces of the cooking cavity 12.

A sub-outlet 36 is formed at the rear portion of the sidewall 33R of the housing 33 so as to allow the cooking cavity 12 to communicate with the machine room 11. This sub-outlet 36 discharges a part of the air from the cooking cavity 12 to an air inlet side of the cooling fan 51 installed in the machine room 11. Both the main-outlet 35 and the sub-outlet 36 are disposed at an upper half of the cooking cavity 12 and include holes 35*a* and 36*a* having a small diameter capable of effectively preventing a leakage of the high-frequency electromagnetic waves from the cooking cavity 12. Further, the holes 35*a*, 36*a* are of sufficient size to allow the combination of air and vapor to be removed from the cooking cavity 12. While not shown, it is understood that the main outlet 35 and the sub outlet 36 can be disposed in other locations, such as the lower half of the cooking cavity 12 are on non-opposing walls.

Figure 5:
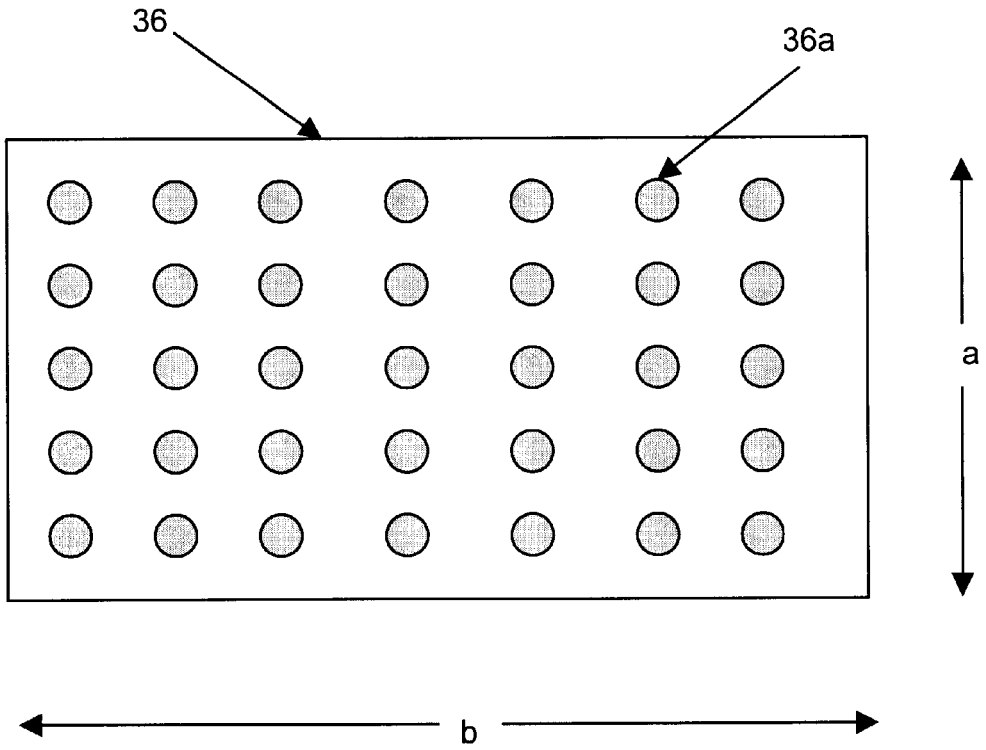
FIG. 5 shows a sub-outlet according to an embodiment of the present invention.

In addition, as shown in FIG. 5, the sub-outlet 36 includes an overall opening having a width of b and a height of a. A piercing ratio is defined as a total area of holes in an opening to a total area of the opening and indicates a density of the openings within an area in which the holes are formed. According to an embodiment of the invention, a piercing ratio of the sub-outlet 36 (i.e., a sum of the areas of the holes 36*a*) to a total area of the overall openings (a×b) is 2% or more greater than a piercing ratio of the holes 34*a* to the total area of the air inlet 34. It is understood that the holes 35*a*, 36*b*, and 34*a* need not be of the same diameter, and that the openings of the outlets 35, 36, and/or the air inlet 34 need not be rectangular in all circumstances.

As shown in FIGS. 3 and 4, the humidity sensor 60 is arranged at the rear section of the machine room 11 so as to be close to the sub-outlet 36. An air guide 70 is provided in the machine room 11 to mount the humidity sensor 60 in the room 11. The air guide 70 also guides air from the sub-outlet 36 to the air inlet side of the cooling fan 51. The air guide 70 accomplishes a close connection of the sub-outlet 36 with the air inlet side of the cooling fan 51. In the shown embodiment, the air guide 70 is cast with the fan bracket 51*a* into a single structure through a plastic injection molding process. However, it is understood that other processes can result in the creation and/or placement of the air guide 70 at the desired location.

The humidity sensor 60 is mounted on the rear surface of the air guide 70 such that it is close to both the air suction holes 32*a* and the sub-outlet 36. Therefore, the air discharged from the cooking cavity 12 through the sub-outlet 36 flows to the air inlet side of the cooling fan 51 under the guide of the air guide 70 at a near parallel direction to a contacting surface of the humidity detector 60 so as to contact the humidity sensor 60. In addition, the atmospheric air sucked into the machine room 11 through the air suction holes 32*a* by the suction force of the cooling fan 51 has a flow direction that is nearly perpendicular to the contacting surface of the humidity sensor 60 and comes into contact with a portion of the humidity sensor 60, thus effectively removing the moisture deposited on the surface of the sensor 60 as will be described in detail later herein. While the air exhausted from the cooking cavity 12 is shown flowing roughly parallel to the contacting surface of the sensor 60, it is understood that the air flow can be in other directions so long as the atmospheric air from the air suction holes 32*a* contacts the contacting surface to remove vapor deposited on the contacting surface.

While designing the microwave oven of this invention, the relative areas of the main-outlet 35 and the sub-outlet 36 should be such that the humidity sensor 60 reliably maintains 50% or more of its ideal sensing performance. In order to accomplish this condition, the outlets 35 and 36 are designed such that a ratio of the total area of the sub-outlet 36 to the total area of both outlets 35 and 36 is roughly between 10 and 25%. The ratio of the area of the sub-outlet to the total area was determined in accordance with several experiments carried by the inventors of this invention, and will be described in more detail with reference to Table 1.

Table 1 shows a variation in the sensing performance of humidity sensor 60 in accordance with ratios of the total areas of the main-outlet 35 and the sub-outlet 36 to the total area of both outlets 35 and 36.

TABLE 1

| Performance of the humidity sensor | Fan rpm | Area of the air inlet | Area of the Main-outlet | Area of the Sub-outlet | Loss |
|---|---|---|---|---|---|
| 100% | 2700 | 100% | 70% | 25% | 5% |
| 70% | 2700 | 100% | 76% | 19% | 5% |
| 50% | 2700 | 100% | 80% | 10% | 5% |

From Table 1, it is apparent that the sensing performance of the humidity sensor 60 is improved in accordance with an increase in the ratio of the area of the sub-outlet 36 to the total area of the outlets 35 and 36. However, the humidity sensor 60 may be easily overheated or contaminated on its surface by the air exhausted from the cooking cavity 12 as the ratio of the sub-outlet 36 to the total area of the two outlets 35 and 36 increases. Therefore, it is preferred to set the ratio of the area of the sub-outlet 36 to the total area of the outlets 35 and 36 as roughly between 10 and 25%. In order to allow the humidity sensor 60 to maintain its ideal sensing performance at 100%, a ratio of the area of the main-outlet 35 to the total area of the outlets 35 and 36 is set to about 70%, and with the ratio of the area of the sub-outlet 36 to the total area is set to about 25%.

The operational effect of the microwave oven of this invention will be described herein below.

In order to cook food A using the microwave oven, the food A is put on the cooking tray 13 inside the cooking cavity 12. After putting the food on the tray 13, the cooking cavity 12 is closed by the door 40 prior to manipulating the control buttons of the control panel 14 to start a desired cooking mode. The magnetron 50 radiates the high-frequency electromagnetic waves into the cooking cavity 12, and the molecular arrangement of moisture in the food A is repeatedly changed to generate intermolecular frictional heat within the food to cook the food.

In addition, the atmospheric air is sucked into the machine room 11 through the air suction holes 32*a* by the suction force of the cooling fan 51, and cools the magnetron 50 and the high-tension transformer 52. The air flows into the cooking cavity 12 through the air inlet 34 under the guide of the air guide duct 53. A part of the atmospheric air sucked into the machine room 11 comes into contact with the humidity sensor 60 positioned close to the air suction holes 32*a*. The air inside the cooking cavity 12 is laden with vapor generated from food A being cooked, and is discharged from the cooking cavity 12 to the outside through the outlets 35 and 36.

Specifically, a part of the air inside the cooking cavity 12 is discharged from the cooking cavity 12 to the atmosphere through the main-outlet 35 as shown by the arrows F1 of FIG. 4, while the remaining air is discharged from the cooking cavity 12 into the machine room 11 through the sub-outlet 36 as shown by the arrows F2 of FIG. 4. The air from the sub-outlet 36 comes into contact with the humidity sensor 60, and the moisture laden in the air is condensed and deposited on the surface of the humidity sensor 60. The resistance of the sensor 60 is changed by the deposited moisture, and the changed resistance of the sensor 60 is converted into a signal outputted to the circuit board of the control panel 14.

In the machine room 11, the air guide 70 provides a close connection of the sub-outlet 36 with the air inlet side of the cooling fan 51 as described above. The suction force of the cooling fan 51 is thus more reliably applied to the sub-outlet 36, and so air is more smoothly discharged from the cooking cavity 12 to the air inlet side of the cooling fan 51.

The humidity sensor 60 senses the humidity of the air exhausted from the cooking cavity 12 while coming into contact with a part of the air discharged from the cavity 12 through the sub-outlet 36. The surface of the humidity sensor 60 is thus less likely to be easily contaminated by contaminants contained in the air exhausted from the cooking cavity 12, and so the sensor 60 maintains its operational performance for a desired lengthy period of time.

As time goes by during the cooking process, the amount of vapor generated from the food A is gradually reduced until there is no new moisture deposited on the surface of the humidity sensor 60. In such a case, the existing moisture deposited on the surface of the humidity sensor 60 is quickly evaporated by atmospheric air, which newly sucked into the machine room 11 due to the suction force of the cooling fan 51. As such, the existing moisture is quickly removed from the humidity sensor's 60 surface.

In an operation of the microwave oven of this invention, the amount of moisture evaporated from the surface of the humidity sensor 60 is more than the amount of moisture newly deposited onto the humidity sensor's 60 surface. Thus, the moisture is easily and quickly removed from the surface of the humidity sensor 60. Therefore, when a cooking process is ended, the humidity sensor 60 returns its initial state, and is capable of effectively and reliably performing its operation.

Figure 6:
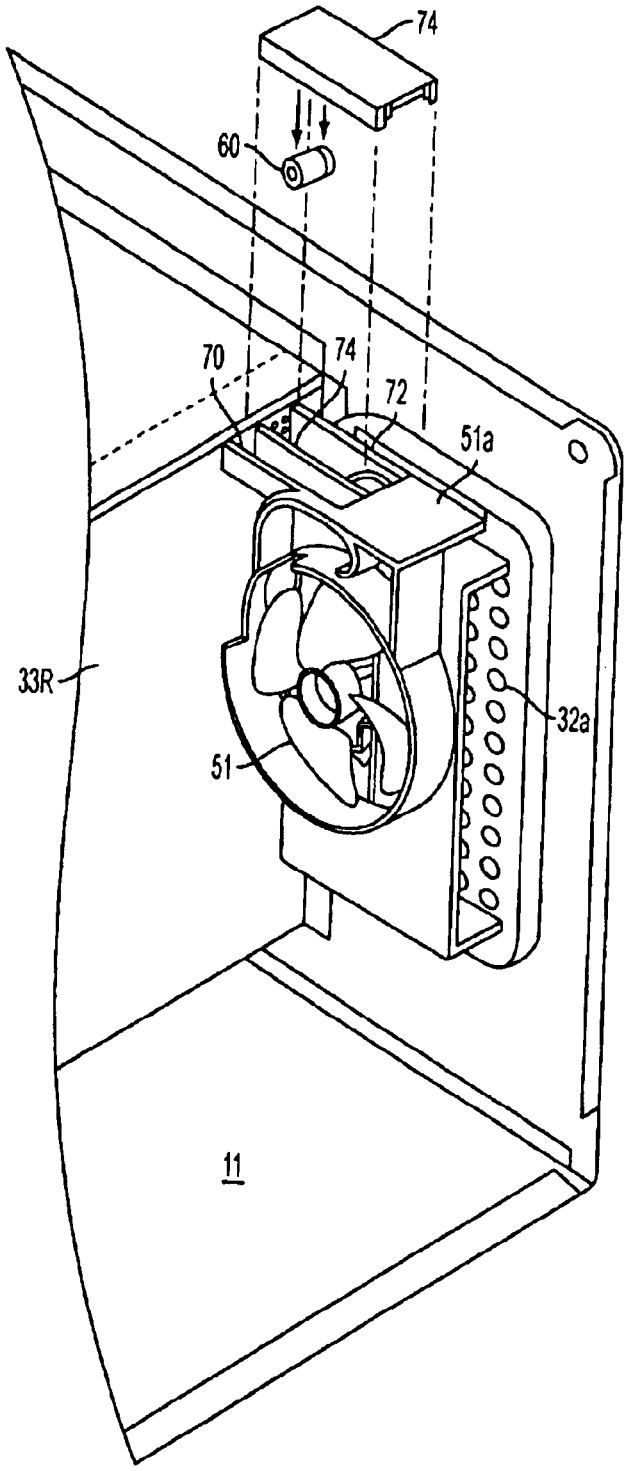
FIG. 6 is a perspective view showing a humidity sensor mounting structure to form a duct provided in the microwave oven according to another embodiment of the present invention.
Figure 7:
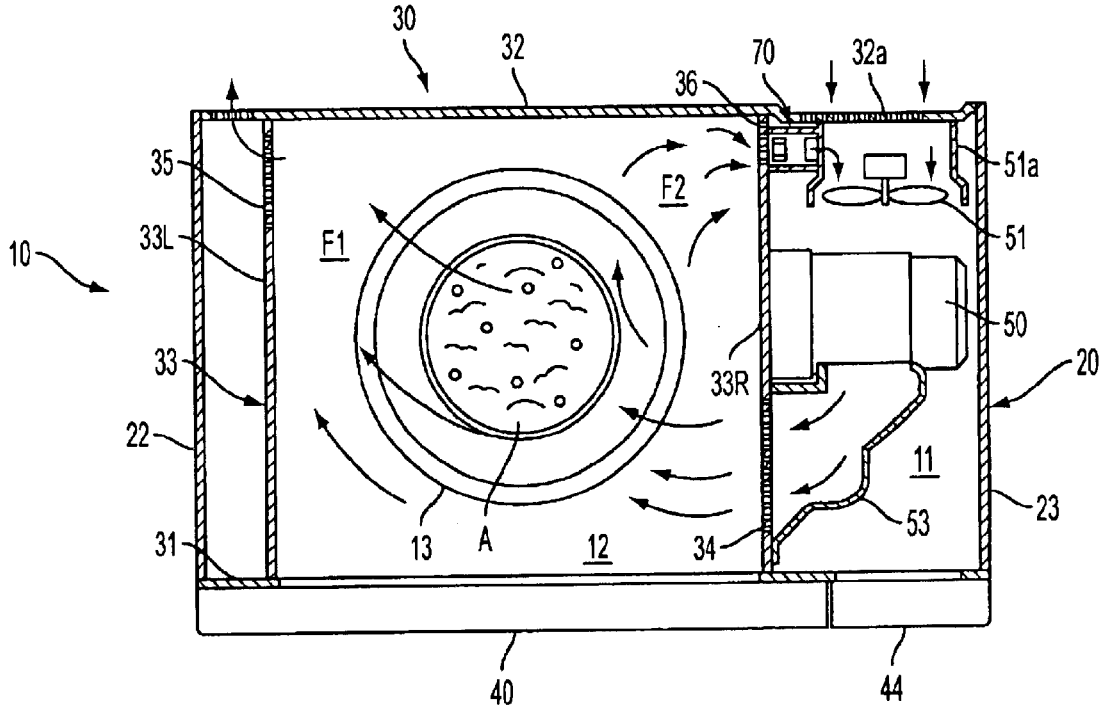
FIG. 7 shows an air outlet structure to discharge air from the cooking cavity of the microwave oven using the humidity sensor mounting structure of FIG. 7 according to another embodiment of the present invention.

According to additional embodiments of the present invention shown in FIGS. 6 and 7, the humidity sensor 60 is mounted in a duct-type air guide 70 that includes a duct 72 including a top 74. By using a duct 72 and a top 74, the humidity sensor 60 is attached between an outer duct wall 76 and an inner duct wall 74. The duct-type air guide 70 allows for a reduction in a size of the sub-outlet 36 due to a reduction in an amount of air that leaks from the air guide 70 so as to maximize the air sensed by the humidity sensor 60. The humidity sensor 60 need not be disposed across the duct-type air guide 70, but may also be placed along one of the walls so long as the humidity sensor 60 is in communication with the air inlet side of the cooling fan 51 and the air exhausted through the sub-outlet 36. The humidity sensor 60 is shown as being a round-type humidity sensor 60 such as that disclosed in U.S. patent application Ser. No. 10/005,223, entitled "POLYMER-TYPE HUMIDITY SENSOR" (Attorney Docket No. 1594.1013), filed Dec. 7, 2001, which is incorporated herein by reference. However, the humidity sensor 60 could also be any type of conventional humidity sensor.

As described above, the present invention provides a microwave oven with a humidity sensor. In the microwave oven of the invention, a main-outlet and a sub-outlet are formed at sidewalls of the cooking cavity such that the cooking cavity communicates with the atmosphere through the main-outlet and with the air inlet side of a cooling fan inside the machine room through the sub-outlet. The humidity sensor is installed in the machine room at a position adjacent to the sub-outlet to sense the humidity of the air inside the cooking cavity by sensing the humidity of a part of the air discharged from the cooking cavity through the sub-outlet. The surface of the humidity sensor is thus less likely to be contaminated by the air exhausted from the cooking cavity. In addition, an amount of new moisture deposited on the surface of the humidity sensor is remarkably reduced just before an end of a cooking process since the amount of vapor generated from food at that time is remarkably reduced such that the moisture deposited on the sensor's surface is quickly evaporated by atmospheric air newly sucked into the machine room due to the suction force of the cooling fan. Therefore, the humidity sensor returns to an initial state at an end of the cooking cycle to be capable of effectively and reliably performing its humidity sensing operation before a start of a next cooking process. The humidity sensor thus performs its desired operation even when the oven sequentially performs several cooking processes.

Although a few preferred embodiments of the present invention have been shown described for illustrative purposes, those skilled in the art will appreciate that various modifications, additions and substitutions are possible, without departing from the scope and spirit of the invention as recited in the accompanying claims and equivalents thereof.

What is claimed is:

1. A microwave oven to cook food comprising:

a body including a cooking cavity and a machine room;

a heating element installed in the machine room and which cooks the food in the cooking cavity;

a cooling fan installed in the machine room and which sucks atmospheric air through an air inlet side of said cooling fan into the machine room and into the cooking cavity while cooling said heating element installed in the machine room;

an air outlet unit to discharge air from the cooking cavity; and a humidity sensor to sense operational conditions of the food in the cooking cavity, wherein said air outlet unit includes:

a main-outlet formed at a sidewall of the cooking cavity to allow the cooking cavity to communicate with the atmosphere outside of said body, and a sub-outlet formed at another sidewall of the cooking cavity to allow the cooking cavity to communicate with the air inlet side of said cooling fan; and said humidity sensor includes a contact surface arranged to both sense a humidity of the air discharged from the cooking cavity through the sub-outlet and to contact the atmospheric air sucked into the machine room so as to prevent said humidity sensor from being overheated and/or contaminated by the air discharged from the cooking cavity.

2. The microwave oven according to claim 1, further comprising an air guide disposed in the machine room to guide the air discharged from the sub-outlet to the air inlet side of said cooling fan; and said humidity sensor is arranged on a rear surface of said air guide so as to be positioned adjacent to the sub-outlet.

3. The microwave oven according to claim 2, wherein the machine room is provided with an air suction hole at a rear wall through which the atmospheric air is sucked into the machine room; and said humidity sensor is arranged adjacent to the air suction hole such that moisture deposited on said humidity sensor is removed from said humidity sensor by the atmospheric air sucked into the machine room through the air suction hole.

4. The microwave oven according to claim 1, wherein the machine room further comprises an air suction hole at a rear wall through which the atmospheric air is sucked into the machine room; and said humidity sensor is arranged adjacent to the air suction hole such that moisture deposited on said humidity sensor is removed from said humidity sensor by the atmospheric air sucked into the machine room through the air suction hole.

5. The microwave oven of claim 1, wherein the contact surface is disposed such that a rate of moisture deposited by the air discharged through the sub-outlet is less than a rate of moisture removed by the atmospheric air sucked into the machine room.

6. The microwave oven of claim 1, wherein, when the cooking of the food is completed, the contact surface returns to an initial state which existed prior to cooking the food due to a removal of moisture on the contact surface by the atmospheric air sucked into the machine room.

7. A microwave oven to cook food, comprising:

a body including a cooking cavity and a machine room;

a heating element disposed in the machine room and which heats the food in the cooking cavity;

a cooling fan installed in the machine room and which sucks atmospheric air through an air inlet side of said cooling fan into the machine room and into the cooking cavity while cooling said heating element installed in the machine room;

an air outlet unit to discharge air from the cooking cavity; and a humidity sensor to sense operational conditions of the food being cooked in the cooking cavity, wherein:

said air outlet unit includes a main-outlet formed at a sidewall of the cooking cavity and which allows air in the cooking cavity to communicate with the atmospheric air exterior to said body, and a sub-outlet formed at another sidewall of the cooking cavity and which allows air in the cooking cavity to communicate with the air inlet side of said cooling fan, a ratio of an area of the sub-outlet to a sum of the areas of the main-outlet and the sub-outlet is roughly between 10 and 25%, and said humidity sensor is arranged to sense a humidity of the air discharged from the cooking cavity through the sub-outlet at a contact surface and to contact at the contact surface the atmospheric air sucked into the machine room.

8. The microwave oven according to claim 7, wherein:

a ratio of an area of the main-outlet to the sum of the areas is roughly between 70 and 75%, and the ratio of the area of the sub-outlet to the sum of the areas is roughly between 20 and 25%.

9. A microwave oven to cook food, comprising:

a cooking cavity to hold the food to be cooked and including an inlet through which air enters said cooking cavity, and first and second outlets through which air is exhausted from said cooking cavity;

a machine room into which air is exhausted through the second outlet and from which the air is introduced into said cooking cavity through the inlet;

a heating element disposed in said machine room and which heats the food in said cooking cavity;

a cooling fan installed in said machine room and which sucks atmospheric air exterior to said machine room into said machine room and into said cooking cavity through the inlet while cooling said heating element in said machine room; and a humidity sensor disposed adjacent to the second outlet to sense operational conditions of the food being cooked by sensing a humidity of the air discharged through the second outlet, wherein:

the inlet and the second outlet comprise holes through which air passes, and a piercing ratio of the sum of the areas of the holes of the second outlet to an area of the second outlet is 2% or more greater than a piercing ratio of the sum of the areas of the holes of the inlet to an area of the inlet.

10. The microwave oven of claim 9, wherein the piercing ratio of the second outlet is 5% or more greater than the piercing ratio of the inlet.

11. The microwave oven of claim 9, wherein a ratio of the area of the second outlet to a sum of the areas of the first and second outlets is roughly between 10 and 25%.

12. The microwave oven of claim 11, wherein a ratio of an area of the first outlet to the sum of the areas is roughly between 70 and 75%.

13. The microwave oven of claim 9, wherein said humidity sensor comprises a contact surface which contacts both the air exhausted through the second outlet and the atmospheric air sucked into said machine room.

14. The microwave oven of claim 13, wherein the contact surface is disposed such that a rate of moisture deposited by the air exhausted through the second outlet is less than a rate of moisture removed by the atmospheric air sucked into said machine room.

15. The microwave oven of claim 13, wherein the contact surface is roughly parallel to an airflow direction of the air exhausted through the second outlet so as to not substantially affect the airflow direction.

16. The microwave oven of claim 13, wherein the contact surface is roughly perpendicular to an airflow direction of the atmospheric air sucked into said machine room such that a portion of the contact surface is in the airflow of the atmospheric air.

17. The microwave oven of claim 16, wherein the contact surface is roughly parallel to an airflow direction of the air exhausted through the second outlet so as to not substantially affect the airflow direction.

18. The microwave oven of claim 17, wherein the first and second outlets are disposed on a top half of first and second sidewalls of said cooking cavity.

19. The microwave oven of claim 18, wherein the inlet is disposed on the second sidewall farther from said cooling fan than the second outlet.

20. The microwave oven according to claim 9, wherein:

said machine room further comprises an atmospheric inlet through which the atmospheric air is sucked into said machine room and an air guide to guide the air exhausted through the second outlet to an area between the atmospheric inlet and said cooling fan; and said humidity sensor is arranged on a rear surface of the air guide so as to be positioned adjacent to the second outlet.

21. The microwave oven according to claim 9, wherein said machine room further comprises an air suction hole at a rear wall to suck the atmospheric air into said machine room; and said humidity sensor is arranged adjacent to the air suction hole such that moisture deposited on said humidity sensor is removed from said humidity sensor by the atmospheric air sucked into said machine room through the air suction hole.

22. A microwave oven to cook food, comprising:

a body including a cooking cavity and a machine room;

a heating element installed in the machine room and which cooks food in the cooking cavity;

a cooling fan installed in the machine room and which sucks atmospheric air through an air inlet side of said cooling fan into the machine room and into the cooking cavity while cooling said heating element installed in the machine room;

an air outlet unit to discharge air from the cooking cavity; and a humidity sensor to sense operation conditions of the food in the cooking cavity, wherein:

said air outlet unit includes a main-outlet formed at a sidewall of the cooking cavity to allow the cooking cavity to communicate with the atmospheric air outside of said body, and a sub-outlet formed at another sidewall of the cooking cavity to allow the cooking cavity to communicate with the air inlet side of said cooling fan, and said humidity sensor includes a contact surface arranged to sense a humidity of the air discharged from the cooking cavity through the sub-outlet and to contact air received through the main-outlet so as to prevent said humidity sensor from being overheated and/or contaminated by the air discharged from the cooking cavity.

23. The microwave oven of claim 22, wherein the air discharged through the sub-outlet flows in a first direction before reaching the contact surface, and the contact surface is disposed in a plane parallel to the first direction.

24. The microwave oven of claim 23, wherein the atmospheric air sucked into the machine room flows in a second direction other than the first direction so as to contact the contact surface as the air discharged through the sub-outlet flows across the contact surface.

25. The microwave oven of claim 22, wherein humidity sensor is arranged such that the air discharged through the sub-outlet flows in a first direction and flows around the humidity sensor.

26. The microwave oven of claim 25, wherein the atmospheric air sucked into the machine room flows in a second direction other than the first direction so as to contact the contact surface as the air discharged through the sub-outlet contacts the contact surface.

27. The microwave oven of claim 25, wherein the humidity sensor comprises a round-type humidity sensor.

* * * * *